US009259074B2

(12) United States Patent
Aso

(10) Patent No.: US 9,259,074 B2
(45) Date of Patent: Feb. 16, 2016

(54) COSMETIC APPLICATION INSTRUMENT

(75) Inventor: Hironori Aso, Yokohama (JP)

(73) Assignee: SINWA CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 14/361,843

(22) PCT Filed: Dec. 1, 2011

(86) PCT No.: PCT/JP2011/077771

§ 371 (c)(1),
(2), (4) Date: Aug. 8, 2014

(87) PCT Pub. No.: WO2013/080352

PCT Pub. Date: Jun. 6, 2013

(65) Prior Publication Data

US 2014/0360529 A1 Dec. 11, 2014

(51) Int. Cl.

| | |
|---|---|
| ***A45D 34/04*** | (2006.01) |
| ***A45D 40/26*** | (2006.01) |
| *A46B 11/00* | (2006.01) |

(52) U.S. Cl.

CPC ..... *A45D 34/046* (2013.01); *A45D 34/042* (2013.01); *A45D 40/26* (2013.01); *A45D 40/262* (2013.01); *A46B 11/0093* (2013.01)

(58) Field of Classification Search

CPC . A45D 34/042; A45D 34/043; A45D 34/045; A45D 34/046; A45D 40/262; A45D 40/264; A45D 40/265; A45D 40/26; A45D 40/28; A46B 2200/20; A46B 2200/1046; A46B 11/0093; A46B 17/08; A61B 2019/4889; B65D 51/32

USPC ..... 132/320; 401/261, 267, 15; 15/248.1, 15/248.2

See application file for complete search history.

(56) References Cited

U.S. PATENT DOCUMENTS 1,906,157 A * 4/1933 Jerousek ..... A46B 11/0093 15/248.1
4,955,745 A * 9/1990 Vauquelin ..... A45D 34/045 141/24

(Continued)

FOREIGN PATENT DOCUMENTS

DE 436626 C * 11/1926 ..... A46B 11/0093
DE 449684 C * 9/1927 ..... A46B 11/0093

(Continued)

OTHER PUBLICATIONS

International Search Report PCT/JP2011/077771 mailed Feb. 13, 2012.

*Primary Examiner* — Robyn Doan
*Assistant Examiner* — Tatiana Nobrega
(74) *Attorney, Agent, or Firm* — Roberts Mlotkowski Safran & Cole, PC

(57) ABSTRACT

A cosmetic application tool is provided which includes an applying portion attached and integrated with a leading end portion of a brush shaft. The applying portion includes a flat, plate-shaped portion surrounded by a hollow, skirt-shaped portion at its distal end. When the brush shaft is drawn out of a cosmetic container, the skirt-shaped hollow portion of the applying portion is flattened by a wiper provided in a surrounding manner within the cosmetic container, so that some of the liquid cosmetic that has been pooled in the skirt-shaped hollow portion is pushed out over the flat plate-shaped portion while some is retained in the skirt-shaped hollow portion of the applying portion. Accordingly, when the brush shaft is inserted into and drawn out of the cosmetic container, the amount of liquid cosmetic retained by the applying portion includes not only the liquid cosmetic that can be retained by both surfaces of the plate-shaped applying portion but also the portion of the liquid cosmetic retained in the hollow portion.

2 Claims, 5 Drawing Sheets

(56) References Cited

U.S. PATENT DOCUMENTS

| | | | | |
|---|---|---|---|---|
| 6,070,598 | A * | 6/2000 | Gueret | 132/320 |
| 2002/0048482 | A1 * | 4/2002 | Gueret | 401/130 |
| 2006/0272670 | A1 * | 12/2006 | Gueret | A45D 34/042 132/317 |
| 2010/0229319 | A1 * | 9/2010 | Phillips | A45D 40/26 15/236.09 |
| 2011/0100866 | A1 * | 5/2011 | Gueret | A45D 40/265 206/581 |
| 2011/0271973 | A1 * | 11/2011 | Iwagaki | A61K 8/027 132/200 |
| 2012/0132222 | A1 * | 5/2012 | Gueret | A45D 40/267 132/200 |
| 2013/0074868 | A1 * | 3/2013 | Shimamura | A45D 34/04 132/320 |
| 2013/0276817 | A1 * | 10/2013 | Holloway | A45D 40/267 132/320 |

FOREIGN PATENT DOCUMENTS

| | | |
|---|---|---|
| GB | 2094235 | 9/1982 |
| JP | 2002-153319 | 5/2002 |
| JP | 2006-094892 | 4/2006 |
| JP | 2006-346469 | 12/2006 |

* cited by examiner

COSMETIC APPLICATION INSTRUMENT

TECHNICAL FIELD

The present invention relates to a cosmetic application tool, and particularly, to a cosmetic application tool for applying a liquid cosmetic such as eye shadow or a lip gloss.

BACKGROUND ART

This type of cosmetic application tool is composed of a brush shaft a base end portion of which serves as an operating portion and an applying portion attached and integrated with a leading end portion of the brush shaft. Said applying portion is, commonly, formed in a thin-walled flat plate shape of an elastic material such as plastic, and is attached and integrated with the brush shaft by fitting, snapping, or press fitting a fitting projection portion formed by extension from a base end portion thereof to the leading end portion of the brush shaft. Moreover, at the inner periphery of an opening portion of a cosmetic container in which a liquid cosmetic is housed, a wiper consisting of a shrinkable member such as rubber is provided in a surrounding manner, and when the brush shaft is drawn out of the cosmetic container, by being scraped by the wiper, the liquid cosmetic adhered to the outer periphery of the brush shaft and the liquid cosmetic excessively adhered to the applying portion are scraped off (refer to Patent Literatures 1 and 2).

CITATION LIST

Patent Literature

Patent Literature 1: Japanese Published Unexamined Patent Application No. 2006-94892 (paragraph numbers 0008 to 0013, FIG. 1 to FIG. 3)

Patent Literature 2: Japanese Published Unexamined Patent Application No. 2006-346469 (FIG. 1, FIG. 4, FIG. 5, FIG. 11 to FIG. 13, etc.)

SUMMARY OF INVENTION

Technical Problem

However, in the conventional cosmetic application tool described above, the amount of the liquid cosmetic that is retained on the applying portion when the brush shaft is drawn out of the cosmetic container has been limited to the amount of adhesion to the thin-walled flat plate-shaped applying portion, i.e., a certain amount the surface area of both surfaces of the applying portion contributes to. In other words, there has been a problem that, by one time of insertion and bringing out of the brush shaft, the liquid cosmetic of an amount more than that retained by both surfaces of the applying portion cannot be brought out of the cosmetic container. This problem has caused trouble while applying making-up for a user who desires a glossy finish by applying a thick layer of the liquid cosmetic because the user needs to perform insertion and drawing out of the brush shaft many times.

The present invention has been made in view of the problems of the conventional technique described above, and an object thereof is to provide an easy-to-use cosmetic application tool which is improved in the amount of a liquid cosmetic retained by the applying portion, and more specifically, to provide a cosmetic application tool including a new mechanism by which, conversely to the conventional art, the amount of a liquid cosmetic retained by the applying portion is increased when being passed through the wiper.

Solution to Problem

In order to achieve the above-described object, a cosmetic application tool according to the first aspect of the present invention is composed of a brush shaft having a base end portion as an operating portion and a flat plate-shaped applying portion attached and integrated with a leading end portion of the brush shaft, in which, in a root portion of at least one surface of the applying portion, a hollow portion that covers the applying portion circumferentially and is opened at a leading end side is provided.

A second aspect of the present invention is the cosmetic application tool according to the first aspect, in which, at a central portion in an applying portion cross direction of the hollow portion, a trough portion that caves in toward the applying portion is formed.

A third aspect of the present invention is the cosmetic application tool according to the first or second aspect, in which the hollow portion is in a tapered shape that becomes gradually broader from a hollow portion base end portion side toward a hollow portion leading end portion side.

Advantageous Effects of Invention

According to the first aspect of the present invention, when the brush shaft of the cosmetic application tool of the present application is drawn out of a cosmetic container, the hollow portion provided in the root of the applying portion is flattened in the process of passing through a wiper provided in a surrounding manner on an opening portion of the cosmetic container, so that a liquid cosmetic that has been pooled in the hollow portion is pushed out. That is, one time of insertion and drawing out of the brush shaft allows bringing, out of the cosmetic container, not only the liquid cosmetic that can be retained by both surfaces of the flat plate-shaped applying portion but also the portion of the liquid cosmetic retained in the hollow portion. Accordingly, because the liquid cosmetic of an amount equivalent to several times of insertion and bringing out of the brush shaft is placed on the applying portion without performing the insertion and drawing out many times, it becomes possible to realize a glossy finish applied with a thick layer of the liquid cosmetic in a short time, so that a cosmetic application tool that is very easy to use for a user can be provided.

Also, providing the hollow portion in the root of the applying portion allows using the wiper provided for wiping off the liquid material adhered to the outer periphery of the brush shaft and the liquid cosmetic excessively adhered to the applying portion, based on an idea contrary to that of the conventional art, in such a manner so as to increase the amount of the liquid cosmetic retained by the applying portion, so that a cosmetic application tool including a new mechanism for which a new function is added to an existing wiper is provided.

According to the second aspect of the present invention, as a result of forming the trough portion in the center of the hollow portion, the hollow portion easily yields to be flattened when passing through the wiper, so that the liquid cosmetic retained in the hollow portion is more effectively pushed out. Also, because (the surface of) the trough portion also serves as a space that can retain the liquid cosmetic, the outer periphery of the hollow portion can also become a part of the applying portion, and a reduction in the surface area of the applying portion from that of the conventional art also never occurs.

According to the third aspect of the present invention, as a result of the hollow portion being tapered to become broader toward the leading end side, when drawing the brush shaft out of the cosmetic container, the brush shaft can be smoothly drawn out without being caught by the wiper.

DESCRIPTION OF EMBODIMENTS

Next, embodiments of the present invention will be described based on examples.

First Example

Figure 1:
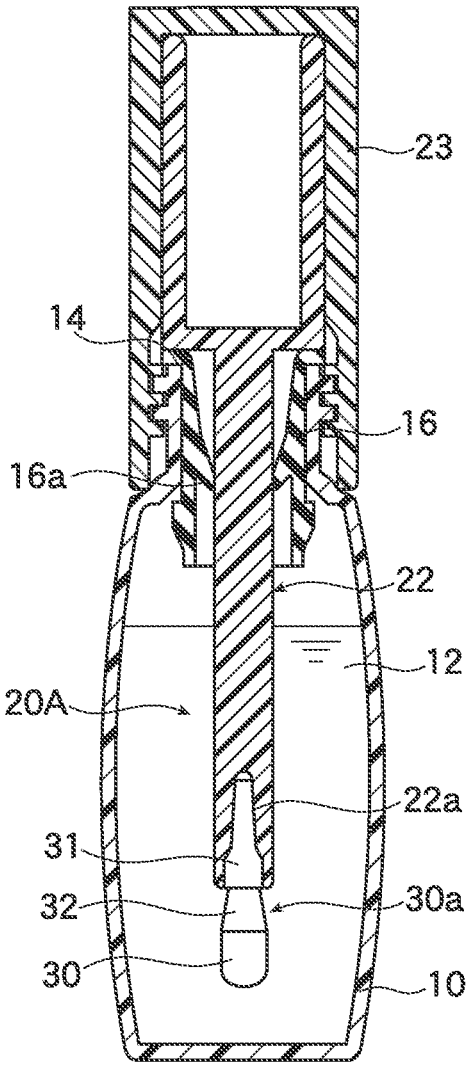
FIG. 1 is a longitudinal sectional view of a cosmetic application tool according to a first example in a state mounted on a cosmetic container.
Figure 2:
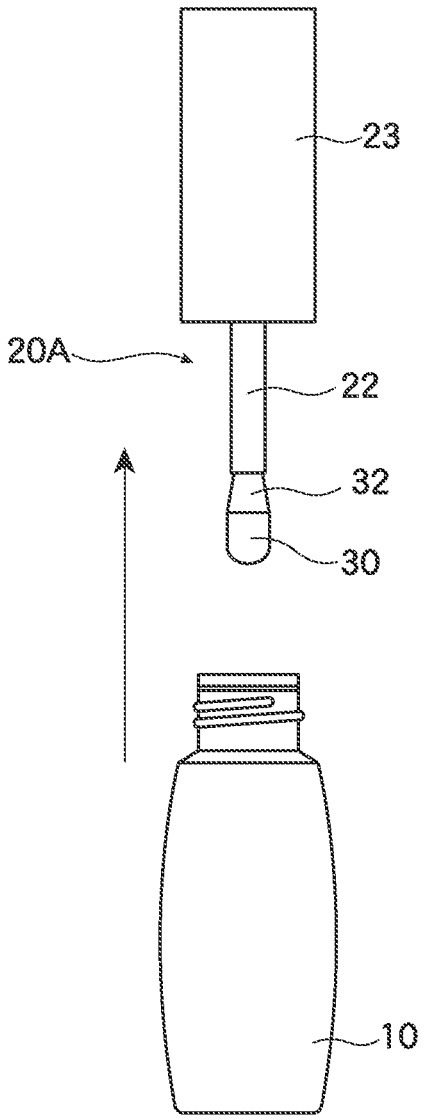
FIG. 2 is a front view of the same cosmetic application tool in a state drawn out of the cosmetic container.
Figure 3:
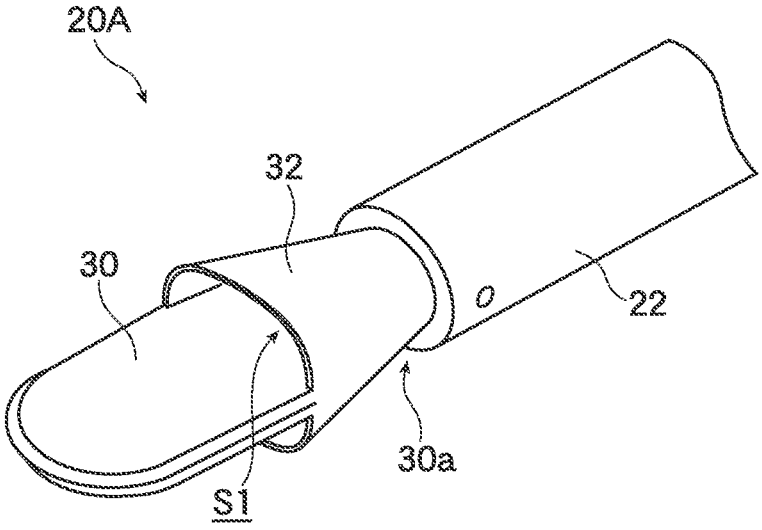
FIG. 3 is a perspective view of the same cosmetic application tool.
Figure 4:
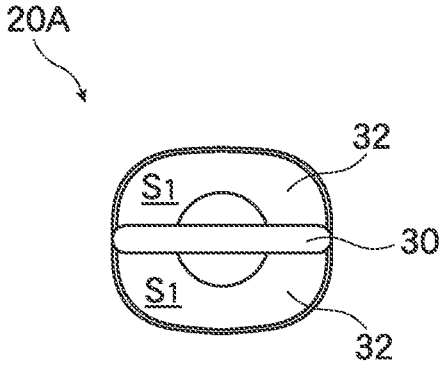
FIG. 4 is a left side view of the same cosmetic application tool.

FIG. 1 to FIG. 4 show a lip brush 20A according to a first example of the present invention, in which FIG. 1 is a longitudinal sectional view of the cosmetic application tool according to the first example in a state mounted on a cosmetic container, FIG. 2 is a front view of the same cosmetic application tool in a state drawn out of the cosmetic container, FIG. 3 is a perspective view of the same cosmetic application tool, and FIG. 4 is a left side view of the same cosmetic application tool.

As shown in FIG. 1, the cosmetic container 10 to which the lip brush 20A being a cosmetic application tool is attached by insertion is in a circular cylindrical shape with a bottom as a whole, is opened upward, and houses inside a gloss liquid 12 being a liquid cosmetic. At the inner periphery of an opening portion 14 of the cosmetic container 10, a wiper 16 consisting of a shrinkable member such as rubber, including a wiping portion 16*a* for scraping off the gloss liquid 12 adhered to the outer periphery of a brush shaft 22 of the lip brush 20A and the gloss liquid 12 excessively adhered to the applying portion 30 (excessively adhered over the inner diameter of the wiping portion 16*a*) when drawing out the brush shaft 22 is attached by fitting.

The lip brush 20A is made up of the brush shaft 22 provided at its base end portion with a cap 23 that can be screwed and attached by insertion into the opening portion 14 of the cosmetic container 10 and the thin-walled flat plate-shaped applying portion 30 coaxially attached and integrated with a leading end portion of the brush shaft 22. The cap 23 of the brush shaft 22 serves also as an operating portion when applying the gloss liquid 12. A fitting projection portion 31 is formed by extension from a base end portion of the applying portion 30, and the applying portion 30 is attached and integrated with the brush shaft 22 by inserting the fitting projection portion 31 into a fitting hole 22*a* formed in the leading end portion of the brush shaft 22 and press fitting the same. The applying portion 30 is formed of an elastic plastic material such as TPU or TPA as an example, and further, in root portions 30*a* at both surfaces of the applying portion 30, hollow portions 32 that cover the applying portion 30 circumferentially (in the applying portion cross direction) and are opened at a leading end side are integrally molded. The hollow portions 32 are formed in a tapered shape that is gradually increased in diameter from a hollow portion base end portion side toward a hollow portion leading end portion side, and each provided as a hollow body extending in an elliptic shape in a left side view so as to surround a half longitudinal region of the applying portion 30 from the applying portion root portion 30*a*.

When the brush shaft 22 of the lip brush 20A is inserted in the cosmetic container 20A, the gloss liquid 12 in the cosmetic container 10 adheres to the applying portion 30 and the brush shaft 22, and the gloss liquid 12 enters spaces S1 between the applying portion 30 and the hollow portions 32.

Next, when the brush shaft 22 of the lip brush 20A is drawn out of the cosmetic container 10, an inner peripheral surface of the wiping portion 16*a* of the wiper 16 remaining at the same diameter is closely fitted to the brush shaft 22, so that the gloss liquid 12 adhered to the outer periphery of the brush shaft 22 wiped off. Next, in a process where the applying portion root portions 30*a*, i.e., the hollow portions 32 pass through the wiper, the inner peripheral surface of the wiping portion 16*a* acts due to its flexibility in a manner of flattening the hollow portions 32, so that the hollow portions 32 are pressed, and the gloss liquid 12 that has been pooled in the spaces S1 is gradually pushed onto the applying portion 30, and is placed on the applying portion 30. Thus, on the applying portion 30, the gloss liquid 12 fed from the spaces S1 is retained, in addition to the gloss liquid 12 that is originally retained on the applying portion 30 because of surface tension. Next, in a process where the applying portion 30 passes through the wiper 16, because of being in a flat plate shape, the applying portion 30 receives substantially no scraping action of the wiping portion 16*a*, so that the gloss liquid 12 placed on the applying portion 30 is retained without being wiped off.

According to the present example, only one time of insertion and drawing out of the brush shaft 22 allows bringing, out of the cosmetic container 10, not only the gloss liquid 12 that can be retained by both surfaces of the flat plate-shaped applying portion 30 but also the portion of the gloss liquid 12 retained in the spaces S1 of the hollow portions 32. Accordingly, because the gloss liquid 12 of an amount equivalent to several times of insertion and bringing out of the brush shaft 22 is placed on the applying portion 30 without performing the insertion and drawing out many times, a glossy finish applied with a thick layer of the gloss liquid 12 can be realized in a short time, which is therefore easy to use for the user.

Also, providing the hollow portions 32 in the root portions 30*a* of the applying portion 30 allows using the wiper 16 provided for wiping off the gloss liquid 12 adhered to the outer periphery of the brush shaft 22 and the gloss liquid 12 excessively adhered to the applying portion 30 in such a manner so as to increase the amount of the gloss liquid 12 retained by the applying portion 30, so that a cosmetic application tool including a new mechanism for which a new function is added to an existing wiper is provided.

Also, when drawing the brush shaft 22 out of the cosmetic container 10, the hollow portions 32 that are tapered to become broader toward the leading end side allows the brush shaft 22 to be smoothly drawn out without being caught by the wiper 16.

Second Example

Figure 5:
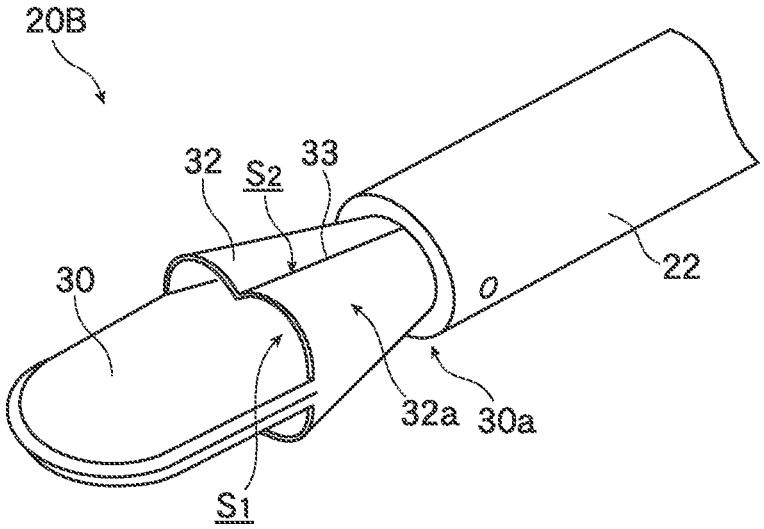
FIG. 5 is a perspective view of a cosmetic application tool according to a second example.
Figure 6:
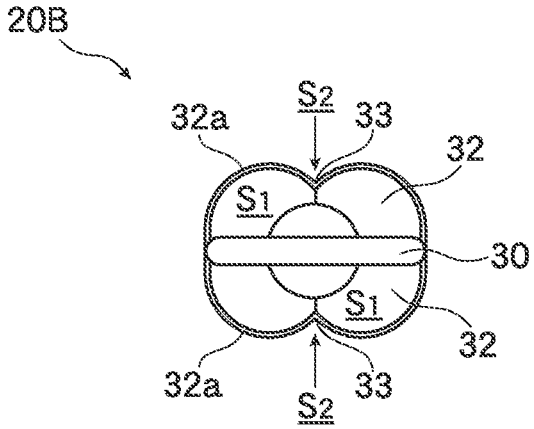
FIG. 6 is a left side view of the same cosmetic application tool.

FIG. 5 and FIG. 6 show a lip brush 20B according to a second example of the present invention, in which FIG. 5 is a perspective view of the cosmetic application tool according to second example, and FIG. 6 is a left side view of the same cosmetic application tool.

For the lip brush 20B, the hollow portions 32 formed in the root portions of the applying portion 30 are changed in shape, and other aspects of the configuration are the same as those of the first example.

In the lip brush 20B, at a central portion in the applying portion cross portion of each hollow portion 32, a trough portion 33 that caves in toward the applying portion 30 (inside) is formed, so that the hollow portions 32 are integrally molded as a hollow body showing a hollow figure-of-eight shape in a left side view (FIG. 6).

According to the present example, only one time of insertion and drawing out of the brush shaft 22 allows bringing, out of the cosmetic container 10, not only the gloss liquid 12 that can be retained by both surfaces of the flat plate-shaped applying portion 30 but also the portion of the gloss liquid 12 retained in the spaces S1 of the hollow portions 32. Furthermore, as a result of forming the trough portion 33 in the center of each hollow portion 32, the hollow portions 32 easily yield to be flattened when passing through (the wiping portion 16*a* of) the wiper 16, so that the gloss liquid 12 retained in the spaces S1 of the hollow portions 32 is effectively pushed out, and the gloss liquid 12 retained in the spaces S1 is almost entirely discharged onto the applying portion 30, that is, the gloss liquid 12 retained in the spaces S1 is in its entire amount effectively placed on the applying portion 30. Thus, because the gloss liquid 12 of an amount greater than that in Example 1 is placed on the applying portion 30 without performing insertion and drawing out of the brush shaft 22 many times, a glossy finish applied with a thick layer of the gloss liquid 12 can be realized in a shorter time, which is therefore very easy to use for the user.

Also, because the gloss liquid 12 is also retained in a space S2 corresponding to a cavity (in the surface) of the trough portion 33, an outer peripheral portion 32*a* of the hollow portion 32 also serves as an applying portion. That is, the lip brush 20B is covered in a root-side half region of the applying portion 30 with the hollow portions 32, which, however, does not lead to a reduction in the surface area of the applying portion 30 from that of the conventional art.

Third Example

Figure 7:
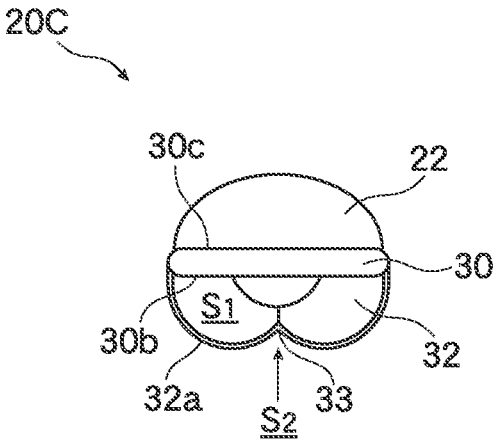
FIG. 7 is a left side view of a cosmetic application tool according to a third example.

FIG. 7 shows a lip brush 20C according to a third example of the present invention, in which FIG. 7 is a left side view of the cosmetic application tool according to the third example.

The lip brush 20C is the same as that of the second example except that the hollow portion 32 that is formed in the root portion of the applying portion 30 is integrally molded only at one surface 30*b* of the applying portion 30.

According to the present example, on the one surface 30*b* of the applying portion, because only one time of insertion and drawing out of the brush shaft 22 allows bringing, out of the cosmetic container 10, not only the gloss liquid 12 that can be retained by the one surface 30*b* but also the portion of the gloss liquid 12 retained in the space S1 of the hollow portion 32, a glossy finish applied with a thick layer of the gloss liquid 12 can be realized in a short time. On the other surface 30*c* of the applying portion, because the gloss liquid 12 can be applied in a spreading manner with use of its flat and smooth surface, a finishing operation can be performed so as to enhance the glossy appearance. That is, the user can obtain a wide variety of senses of use with the single lip brush 20C.

In addition, in Examples 1 to 3, the applying portion 30 and the hollow portion(s) 32 may be processed, by applying thereto electrostatic flocking, for a further improvement in the amount of the liquid cosmetic to be retained. Also, the cosmetic application tool may of course be provided, by flocking only at the side of one surface 30*b* of the applying portion 30 and making the side of the other surface 30*c* remain as a flat and smooth surface without flock, as one that allows obtaining a wider variety of senses of use.

In addition, there may be provided an arrangement, by making cuts at several to multiple circumferential points in the wiping portion 16*a* of the wiper 16, such that insertion and drawing out of the hollow portion (s) 32 becomes more smooth.

INDUSTRIAL APPLICABILITY

In Examples 1 to 3, a description has been given with an assumption that the cosmetic application tool being the present invention is a lip brush, however, the present invention can also be applied as a cosmetic application tool for another liquid cosmetic such as eye shadow as well.

REFERENCE SIGNS LIST

10 Cosmetic container
12 Gloss liquid being a liquid cosmetic
16 Wiper
16*a* Wiping portion of wiper
20A Lip brush according to the first example
20B Lip brush according to the second example
20C Lip brush according to the third example
22 Brush shaft
23 Cap (operating portion)
30 Applying portion
30*a* Root portion
32 Hollow portion
33 Trough portion
S1 Space between applying portion and hollow portion
S2 Space in the surface of trough portion

The invention claimed is:

1. A cosmetic application tool, comprising a flat plate applying portion which has a root or proximal portion integrated with a leading end portion of a shaft, and a distal applying portion extending longitudinally from the proximal portion to a free distal end; and a hollow portion having a base end extending from the shaft that circumferentially covers the proximal portion of the flat plate applying portion but does not cover any of the distal applying portion of the flat plate applying portion, wherein the hollow portion includes a closed proximal end connected around the proximal portion of the flat plate applying portion, and an open distal end, and a trough portion which extends longitudinally along a center portion of the hollow portion and caves inwardly.

2. The cosmetic application tool according to claim 1, wherein the hollow portion is tapered, becoming gradually broader from the closed proximal end to the open distal end.

* * * * *